US006898854B2

(12) United States Patent
Zemlok et al.

(10) Patent No.: US 6,898,854 B2
(45) Date of Patent: May 31, 2005

(54) MODULAR POWER TOOL

(75) Inventors: Michael A. Zemlok, Towson, MD (US); Keith Moore, Owings Mills, MD (US); Weston J. Van Wambeke, Baltimore, MD (US)

(73) Assignee: Black & Decker Inc., Newark, DE (US)

( * ) Notice: Subject to any disclaimer, the term of this patent is extended or adjusted under 35 U.S.C. 154(b) by 76 days.

(21) Appl. No.: 10/165,167

(22) Filed: Jun. 7, 2002

(65) Prior Publication Data

US 2003/0226264 A1 Dec. 11, 2003

(51) Int. Cl.[7] ..... B27B 9/00
(52) U.S. Cl. ..... 30/122; 30/388
(58) Field of Search ..... 30/122, 388, 389, 30/390, 391, 517, 518, 519, 520, 521, 522, 523, 524; 173/216, 217, 93.5

(56) References Cited

U.S. PATENT DOCUMENTS

| | | | |
|---|---|---|---|
| 2,545,659 | A | 3/1951 | Ginter |
| 2,962,062 | A | 11/1960 | Winkler et al. |
| 2,989,995 | A | 6/1961 | Happe |
| 3,262,472 | A | 7/1966 | McCarty et al |
| 3,456,696 | A | 7/1969 | Gregory et al. |

(Continued)

FOREIGN PATENT DOCUMENTS

| | | | |
|---|---|---|---|
| DE | 3318507 | C2 | 11/1985 |
| DE | 3429095 | C2 | 1/1989 |
| DE | 3740200 | A1 | 6/1989 |
| DE | G9115492.8 | | 4/1992 |
| DE | G9406040.1 | | 7/1994 |

(Continued)

OTHER PUBLICATIONS

Reg. #49811851, no dates, Germany.
Reg. #49911612, no dates, Germany.

*Primary Examiner*—Stephen Choi
(74) *Attorney, Agent, or Firm*—Harness, Dickey & Pierce, P.L.C.

(57) ABSTRACT

A modular power tool incorporates a modular drive system and modular handle set that is reversible for use with both a left hand and right hand configuration. The modular drive system and handle set of the modular power tool of this invention reduces the need for derivative circular saw designs by introducing common components.

11 Claims, 5 Drawing Sheets

U.S. PATENT DOCUMENTS

| | | | | |
|---|---|---|---|---|
| 3,730,239 | A | | 5/1973 | Kaman et al. |
| 3,757,194 | A | | 9/1973 | Weber et al. |
| 3,759,019 | A | | 9/1973 | Wells |
| 3,873,862 | A | | 3/1975 | Butler |
| 4,060,940 | A | * | 12/1977 | DeWitt ..... 451/358 |
| 4,145,811 | A | * | 3/1979 | Kendzior ..... 30/394 |
| 4,221,051 | A | | 9/1980 | Glass |
| 4,224,855 | A | | 9/1980 | Des Roches |
| D262,772 | S | | 1/1982 | Glass et al. |
| 4,326,370 | A | | 4/1982 | Thorud |
| 4,355,785 | A | | 10/1982 | Tosato et al. |
| 4,369,546 | A | | 1/1983 | Zientara |
| 4,516,324 | A | | 5/1985 | Heininger, Jr. et al. |
| 4,555,849 | A | | 12/1985 | Ando et al. |
| 4,609,053 | A | | 9/1986 | Ragnmark |
| 4,847,513 | A | | 7/1989 | Katz et al. |
| 4,856,394 | A | | 8/1989 | Clowers |
| 4,870,758 | A | | 10/1989 | Fushiya |
| 4,876,797 | A | | 10/1989 | Zapata |
| 5,006,740 | A | | 4/1991 | Palm |
| 5,023,999 | A | | 6/1991 | Looper et al. |
| 5,090,126 | A | | 2/1992 | Higgins |
| D329,363 | S | | 9/1992 | Sasaki et al. |
| 5,170,851 | A | | 12/1992 | Kress et al. |
| D335,433 | S | | 5/1993 | Schultz et al. |
| 5,433,008 | A | | 7/1995 | Barger, Jr. et al. |
| D363,656 | S | | 10/1995 | Gierke |
| D375,439 | S | | 11/1996 | Niwa et al. |
| D390,081 | S | | 2/1998 | Price et al. |
| 5,856,715 | A | | 1/1999 | Peot et al. |
| 5,881,823 | A | | 3/1999 | Kabatnik et al. |
| 5,902,080 | A | | 5/1999 | Kopras |
| D411,425 | S | | 6/1999 | Sugimoto et al. |
| D417,648 | S | | 12/1999 | Clowers et al. |
| 6,007,939 | A | | 12/1999 | Clowers |
| D427,872 | S | | 7/2000 | Snider |
| D427,874 | S | | 7/2000 | Hayakawa et al. |
| D428,318 | S | | 7/2000 | Gallagher et al. |
| D428,319 | S | | 7/2000 | Gallagher |
| D429,133 | S | | 8/2000 | Lui |
| 6,108,916 | A | | 8/2000 | Zeiler et al. |
| D432,077 | S | | 10/2000 | Zurwelle et al. |
| 6,161,293 | A | | 12/2000 | Watson |
| 6,181,032 | B1 | | 1/2001 | Marshall et al. |
| 6,502,647 | B1 | * | 1/2003 | Krzyzewski et al. ..... 173/170 |
| 6,536,120 | B1 | * | 3/2003 | Langis ..... 30/391 |
| 2001/0000552 | A1 | | 5/2001 | Watson |
| 2003/0121679 | A1 | * | 7/2003 | Taga ..... 173/93.5 |

FOREIGN PATENT DOCUMENTS

| | | | |
|---|---|---|---|
| DE | 4040091 | C2 | 7/1995 |
| DE | 4403189 | A1 | 8/1995 |
| DE | 29513330 | U1 | 2/1997 |
| DE | 19635527 | A1 | 2/1998 |
| DE | 19938523 | A1 | 4/2000 |
| EP | 466294 | B1 | 10/1995 |
| JP | 57-207003 | | 12/1982 |
| JP | 58-222803 | | 12/1983 |
| JP | 58-222804 | | 12/1983 |
| JP | 59-167202 | | 9/1984 |
| JP | 61-53922 | | 11/1986 |
| JP | 61-54561 | | 11/1986 |
| JP | 61-57161 | | 12/1986 |
| JP | 62-35362 | | 8/1987 |
| JP | 2-45561 | | 10/1990 |
| JP | 2-48232 | | 12/1990 |
| JP | 2-303776 | | 12/1990 |
| JP | 3-38961 | | 6/1991 |
| JP | 3-503986 | | 9/1991 |
| JP | 05004201 | A | 1/1993 |
| JP | 05031701 | A | 9/1993 |
| JP | 05318403 | A | 12/1993 |
| JP | 6-278101 | | 10/1994 |
| JP | 07052067 | A | 2/1995 |
| JP | 7-161340 | | 6/1995 |
| JP | 7-67681 | | 7/1995 |
| JP | 7-232301 | | 9/1995 |
| JP | 8-281603 | | 10/1996 |
| JP | 9-141602 | | 6/1997 |
| JP | 9-141603 | | 6/1997 |
| JP | 9-164501 | | 6/1997 |
| JP | 10-34564 | | 2/1998 |
| JP | 11-170203 | | 6/1999 |
| JP | 2000-15602 | | 1/2000 |
| JP | 2000-176908 | | 6/2000 |
| JP | 3098801 | | 8/2000 |
| WO | WO 00/51772 | | 9/2000 |

* cited by examiner

MODULAR POWER TOOL

FIELD OF THE INVENTION

The present invention relates generally to a modular power tool. In particular, the present invention relates to a modular circular saw wherein the handle supports the drive assembly and is adaptable to be fastened on either side of the saw blade, providing a right hand and left hand assembly.

BACKGROUND OF THE INVENTION

Circular saws are known in the art. A growth in circular saw applications has created many derivative circular saw designs for each specific type of use. Many of these applications require changes to motor platforms, blade guarding and gear cases. Specifically, most circular saw designs do not allow different motor sizes to fit the same housing. This requires a housing redesign and a new transmission for each different or new motor size. The transmission or gear case is typically the most complex component to develop and dimensionally qualify because it has the most stringent tolerances and becomes the foundation for all the other structure that is mounted to it. Hence, the product development time for a derivative circular saw is extensive and somewhat prohibitive.

In addition, there is a need for a left and right hand blade applications with respect to the handle set for many circular saw designs, which usually requires a handle set redesign. The design of the handle set is complicated because generally battery applications or power sources fit onto the handle set. Thus, development of a new handle set for each circular saw product creates a tremendous amount of design resources, tooling cost and development time.

Accordingly, a need exists for a modular power tool for a circular saw application having the ability to incorporate numerous gear cases, motor platforms and guard designs, with a handle operable in both a left hand and right hand configuration.

SUMMARY OF THE INVENTION

The present invention provides a modular power tool for a circular saw application. The modular power tool incorporates a modular drive system that employs a mounting flange portion with a common hole pattern for coupling motors of various sizes to a universal gear case. The handle set of the modular power tool is designed with a cavity through which the drive system passes. The handle set further includes a universal mating portion for receipt of a variety of battery and power sources. The handle set is also reversible for use with both a left hand and right hand configuration. The modular drive system and handle set of the modular power tool of this invention reduces the need for derivative circular saw designs by introducing common components.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
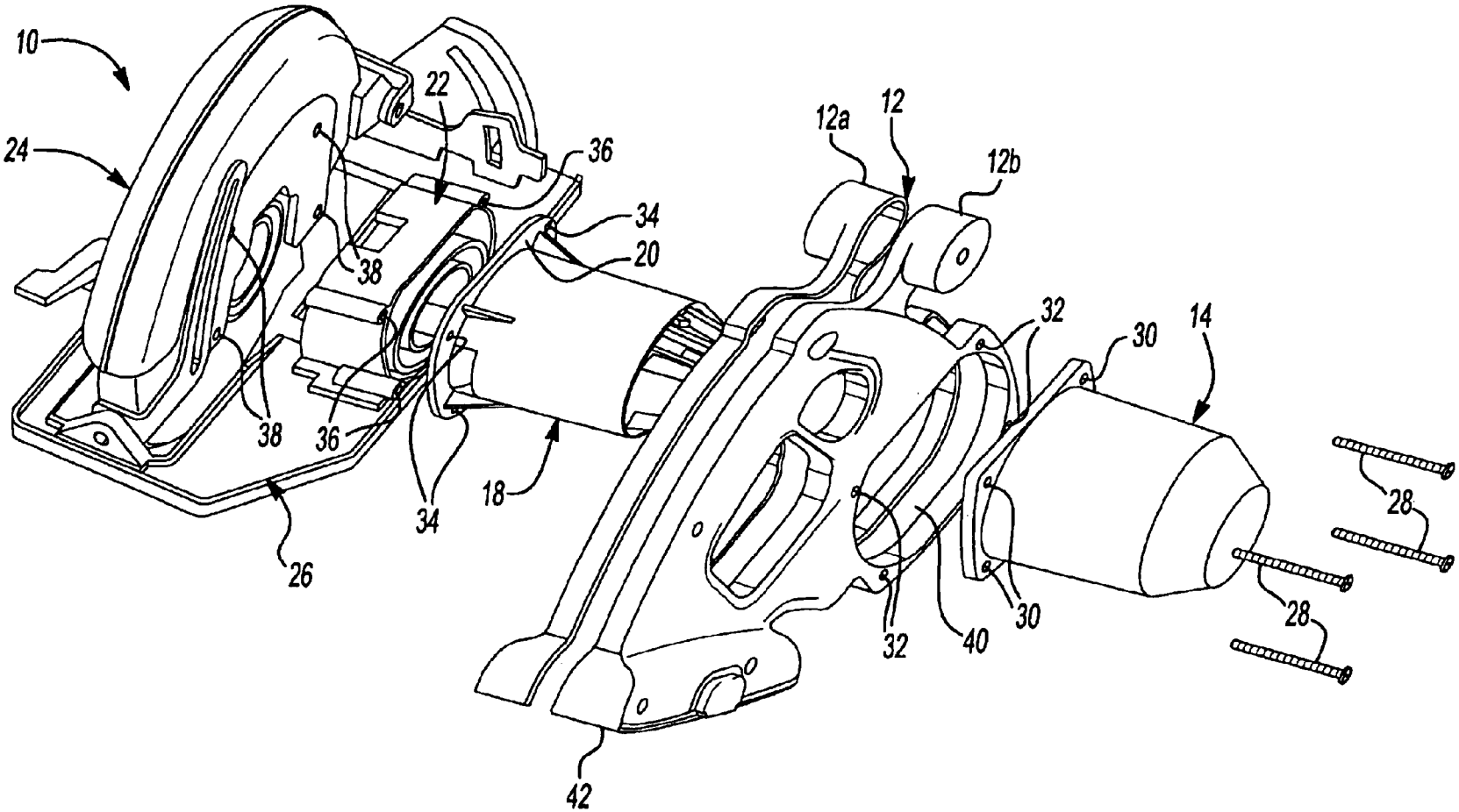
FIG. 1 is an exploded perspective view of a modular power tool in a left hand orientation according to the principles of the present invention.
Figure 2:
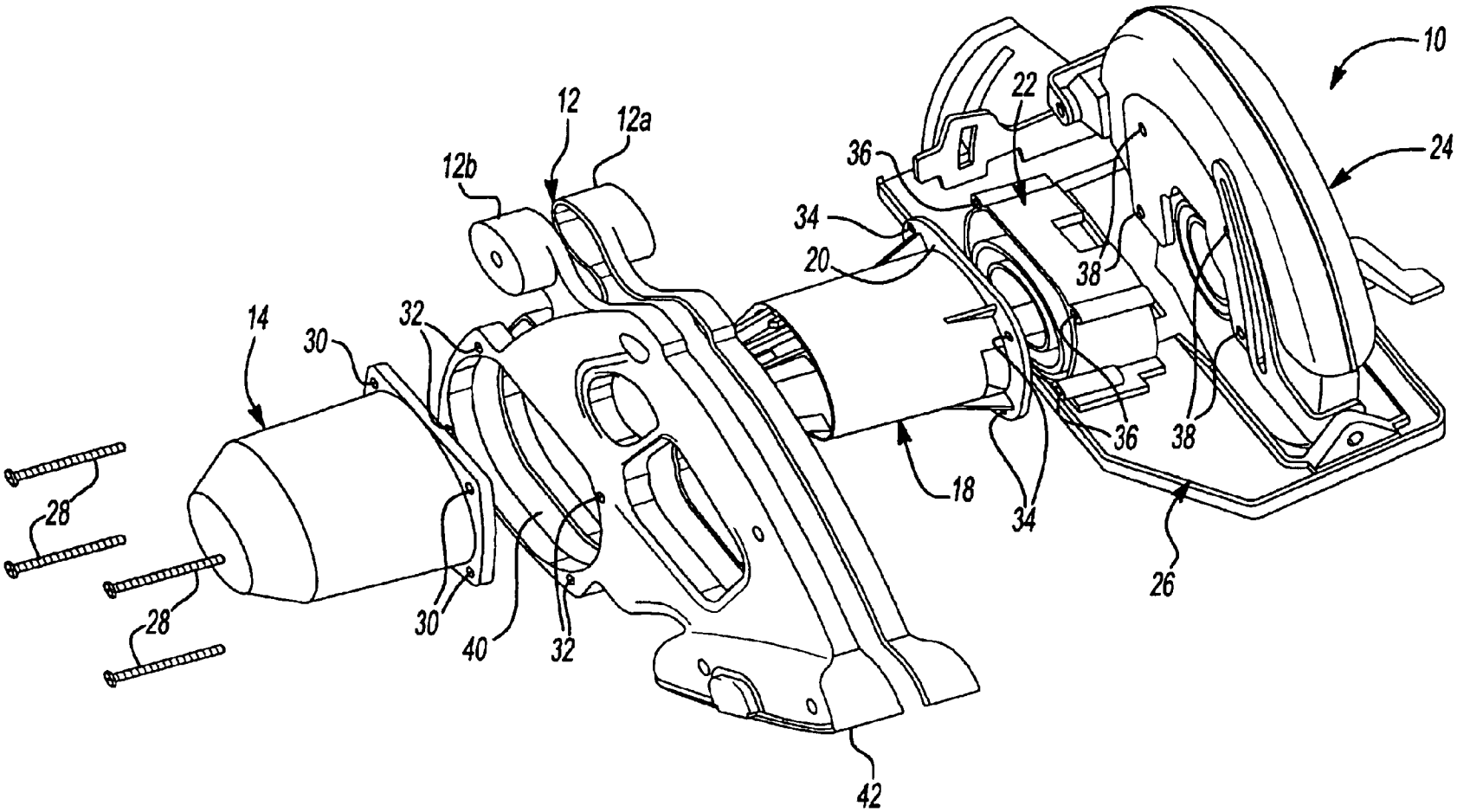
FIG. 2 is an exploded view of the modular power tool in a right hand orientation.

Referring generally to FIGS. 1 and 2, an exploded view of a first embodiment of a modular power tool 10 is shown. The present invention is directed towards a circular saw, however, it is to be understood that the principles embodied herein are equally applicable to other types of power tools as well.

The modular power tool or power circular saw 10 includes a reversible clam shell handle set 12 with a symmetrical motor housing 14. A universal drive train platform is provided with a motor case 18 which has a flange 20 and mounting hole pattern which is designed for the largest motor, such that smaller motors can be provided with the same flange and hole pattern. The universal drive train platform also includes a universal gear case 22. Various guards 24 and shoe assemblies 26 can be provided for a specific saw application such as right and left hand blade applications, wood or metal cutting, etc. Fasteners 28 extend through mounting holes 30, provided in the symmetrical motor housing 14, holes 32, provided in the reversible clam shell handle set 12, holes 34, provided in the flange 20 of the motor case 18, mounting holes 36, provided in the universal gear case 22 and finally into mounting holes 38 provided in guard 24.

The symmetrical motor housing 14 can be made out of one or two pieces. The symmetrical motor housing 14 is generally made from plastic and encloses an end of the motor case 18. Different size symmetrical motor housings 14 can be optionally used to reduce the size of the assembly for different motor sizes. This reduces the cost and development time required of an entire new housing tool. The symmetrical motor housing 14 is coupled to the two-piece clam shell handle set 12.

Figure 3:
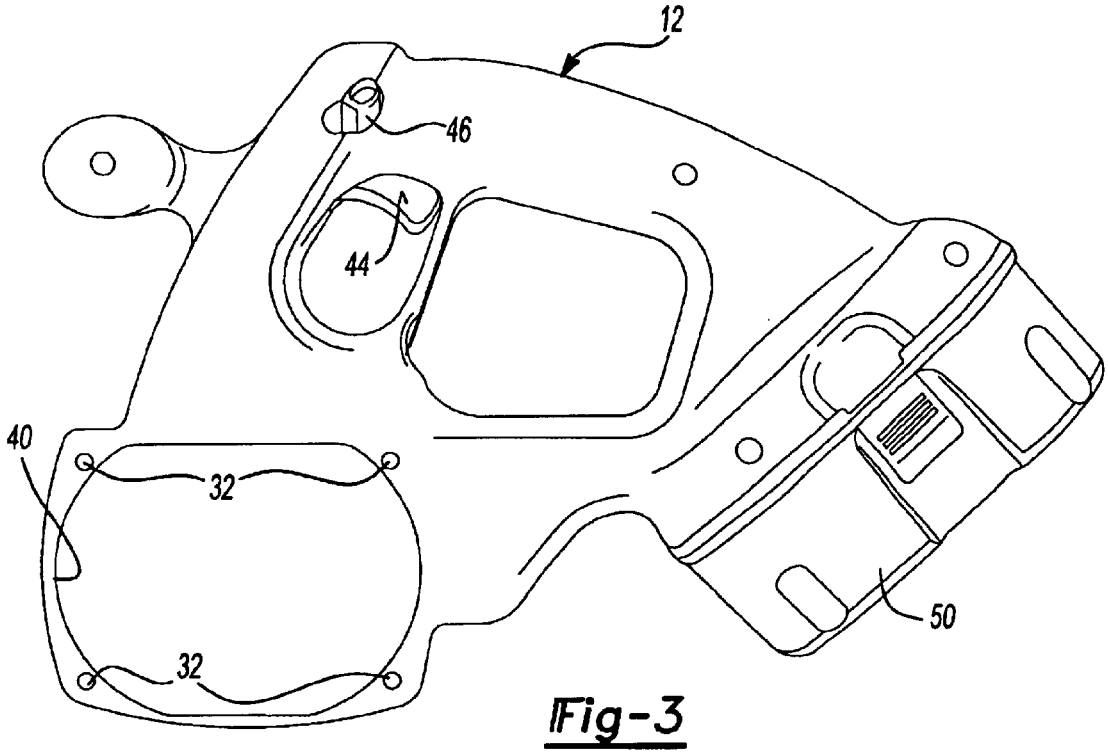
FIG. 3 is a side view of a handle set according to the principles of the present invention.

The two-piece clam shell handle set 12 incorporates an identical and symmetrical mounting pattern on both sides of each clam shell portion 12*a*, 12*b*. This clam shell handle set 12 has an opening 40 that allows the entire range of desired motor cases 18 to pass through it for mounting onto the universal gear case 22. The clam shell handle set 12 also supports the motor case 18 for coupling to the symmetrical motor housing 14. In addition, clam shell handle set 12 has an open end cavity 42 (best shown in FIG. 2) designed so that different mold inserts can be used for different battery and power sources to be connected to the power circular saw 10. Clam shell handle set 12 further includes a trigger 44 and a safety 46 (best shown in FIG. 3). Both trigger 44 and safety 46 are generally made from plastic. Safety 46 extends through the clam shell handle set 12, and must be held for the trigger 44 to release.

Figure 4:
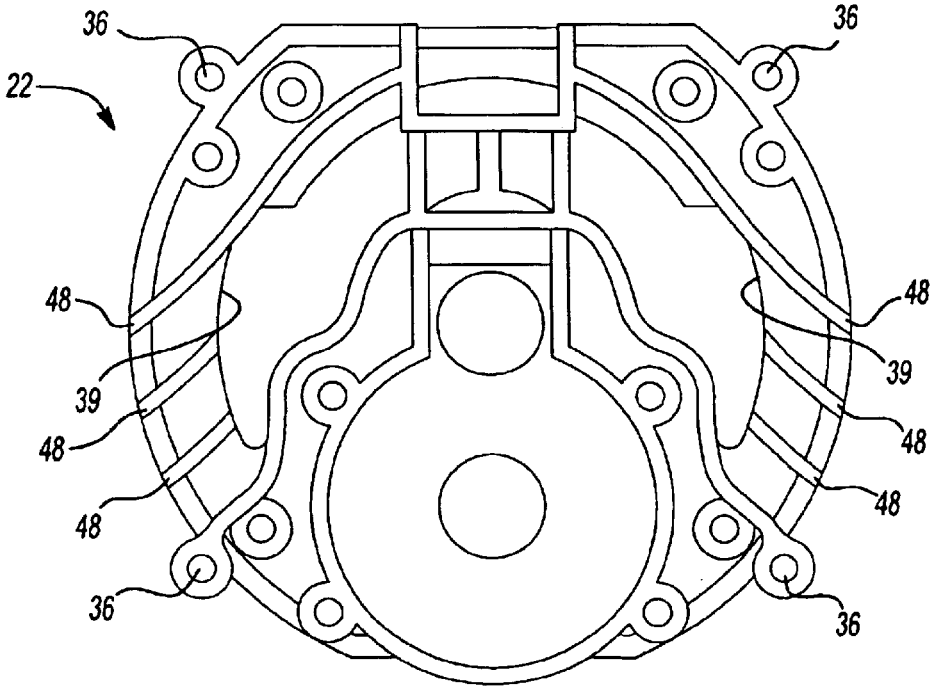
FIG. 4 is a front view of a gear case according to the principles of the present invention.

The modular universal transmission and gear case 22 is symmetrical and has the ability to incorporate numerous gear ratios, motor platforms and guard designs. In addition, as shown in FIG. 4, the universal gear case 22 has symmetrical air flow vents 39 with fins and ribbing 48 that can direct air to remove dust and debris from a cutting line in both right and left handed blade applications.

Figure 5:
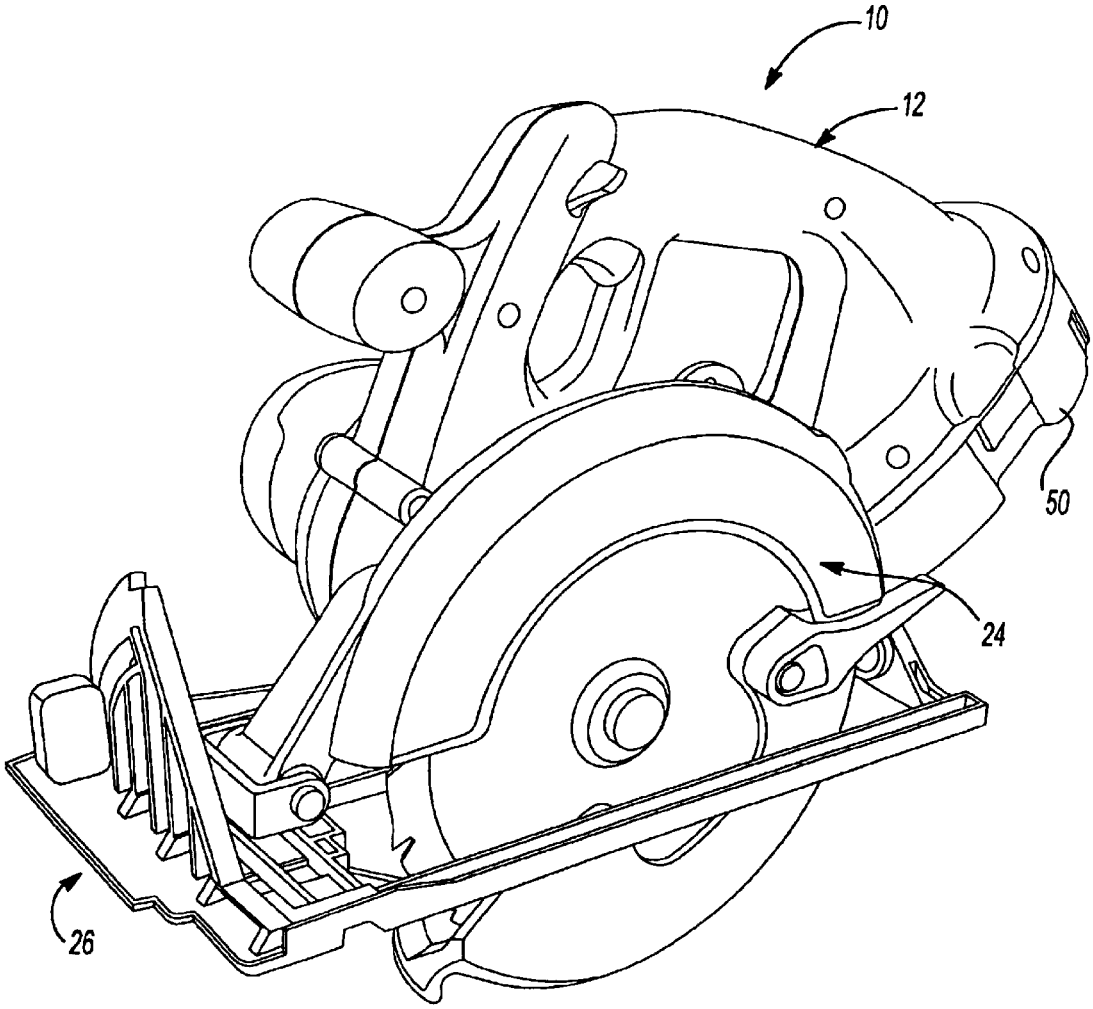
FIG. 5 is a perspective view of the modular circular saw in a left hand configuration.
Figure 6:
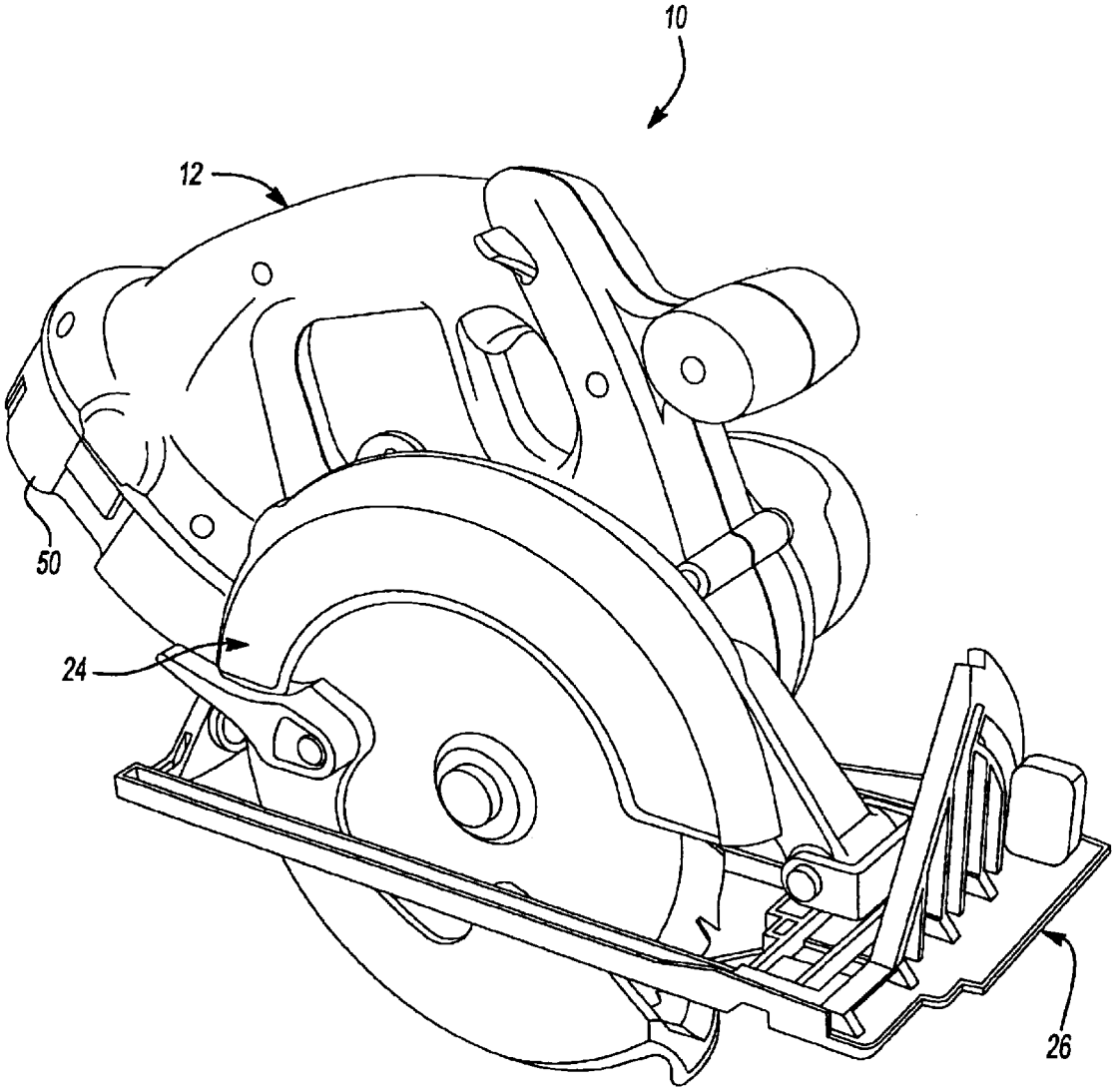
FIG. 6 is a perspective view of the right hand configuration of the modular circular saw according to the principles of the present invention.

Referring generally to FIGS. 1 and 2, the assembly of power circular saw 10 generally involves inserting motor case 18 through the cavity 40 of the clam shell handle set 12. The motor case 18 has a flange 20 with holes 34 which couple the universal gear case 22 to the motor case 18. The universal gear case 22 is further coupled to the guard and shoe assembly 24, 26. Symmetrical motor housing 14 is fixed to the end of the clam shell handle set 12 such that it covers the rest of the motor case 18. The symmetrical motor housing 14 provides the starting point for the fasteners 28, specifically fasteners 28 are threaded though the symmetrical motor housing 14 via holes 30 into the clam shell handle set 12 via holes 32, through motor assembly holes 34, the gear case holes 36 and into the guard 24. The battery 50 (FIGS. 5 and 6) or other power source are mounted onto cavity 42. The left hand assembly for the power circular saw 10 is shown FIG. 5. The right hand assembly for the power circular saw 10 is shown in FIG. 6 and is achieved by reversing the orientation of the clam shell handle set 12.

The design of the present invention allows the clam shell handle set 12 to be mounted either to the left or to the right of the blade and gear case. Features that allow this arrangement include the identical and symmetrical mounting fasteners on both sides of each handle clam shell. In addition, the handle set defines an opening that is large enough for the entire range of different sized motor assemblies to pass through it. Furthermore, the motor housing and gear case are symmetrically designed for left hand and right hand use, The blade guard and shoe can be changed for different uses and for left or right hand orientations.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A modular power tool comprising:

drive system;

a housing defining a chamber for said drive system;

a handle defining a through cavity, having a first side and a second side, said first side of said handle engages one of said drive system and said housing and said second side of said handle engages the other of said drive system and said housing; and wherein, said drive system, said housing and said handle are adaptable for use in a left and right hand orientation, wherein in said left hand orientation, said housing is mounted on said first side of said handle and in said right hand orientation, said housing is mounted on said second side of said handle.

2. The modular power tool of claim 1 further including:

a guard coupled to said drive system; and a shoe mounted to said guard.

3. The modular power tool of claim 1 wherein said drive system further includes:

a motor; and a gear case coupled to said motor.

4. The modular power tool of claim 3, wherein said gear case includes a pair of substantially symmetrical air flow passages which enables said gear case to provide ventilation regardless of orientation.

5. The modular power tool of claim 4 wherein said air flow passages have substantially symmetrical fins and ribbing.

6. The modular power tool of claim 1 wherein said handle is adaptable to receive a power supply.

7. The modular power tool of claim 1 wherein said handle includes left and right shells.

8. The modular power tool of claim 1 wherein said drive system further includes a flange for coupling to said handle.

9. The modular power tool of claim 1 wherein said housing further includes a flange for coupling to said handle.

10. The modular power tool of claim 1 wherein said housing is symmetrical.

11. The modular power tool of claim 1 wherein said handle, said drive system and said housing are connected by a plurality of common fasteners.

* * * * *